US010304434B2

(12) United States Patent
Kluge

(10) Patent No.: US 10,304,434 B2
(45) Date of Patent: May 28, 2019

(54) METHODS, DEVICES AND COMPUTER PROGRAM PRODUCTS FOR INTERACTIVE MUSICAL IMPROVISATION GUIDANCE

(71) Applicant: Qluge AS, Stavanger (NO)

(72) Inventor: Espen Kluge, Stavanger (NO)

(73) Assignee: Qluge AS, Stavanger (NO)

( * ) Notice: Subject to any disclaimer, the term of this patent is extended or adjusted under 35 U.S.C. 154(b) by 0 days.

(21) Appl. No.: 15/579,416

(22) PCT Filed: Jun. 3, 2016

(86) PCT No.: PCT/NO2016/050114

§ 371 (c)(1),
(2) Date: Dec. 4, 2017

(87) PCT Pub. No.: WO2016/195510

PCT Pub. Date: Dec. 8, 2016

(65) Prior Publication Data

US 2018/0144732 A1 May 24, 2018

(30) Foreign Application Priority Data

Jun. 5, 2015 (NO) ..... 20150729

(51) Int. Cl.
*G10H 1/36* (2006.01)
*G10H 1/38* (2006.01)
(Continued)

(52) U.S. Cl.
CPC ..... *G10H 1/38* (2013.01); *G10H 1/0008* (2013.01); *G10H 1/0025* (2013.01); *G10H 1/36* (2013.01);
(Continued)

(58) Field of Classification Search
CPC ..... G10H 1/0025; G10H 1/38; G10H 1/36; G10H 1/383; G10H 2240/145;
(Continued)

(56) References Cited

U.S. PATENT DOCUMENTS 4,756,223 A 7/1988 Murakami
5,777,253 A * 7/1998 Kurebayashi ..... G10H 1/36 84/613

(Continued)

FOREIGN PATENT DOCUMENTS

| | | |
|---|---|---|
| JP | 2004029720 | 1/2004 |
| WO | 2013/028315 | 2/2013 |
| WO | 2013/182515 | 12/2013 |

OTHER PUBLICATIONS

Norwegian Search Report, Norwegian Patent Application No. 20150729, dated Sep. 7, 2015.

(Continued)

*Primary Examiner* — Marlon T Fletcher
(74) *Attorney, Agent, or Firm* — Andrus Intellectual Property Law, LLP

(57) ABSTRACT

A method and a device provides a user with the ability to freely improvise or play around with a selection of different chords and be provided with visual guidance assisting the improvisation of melody, while also providing accompaniment consistent with the selection of chords. Sound files consistent with a user selection of a chord and/or a dynamic level are selected from an audio library and played, while the user is given visual cues on a user interface keyboard assisting the user to select notes that are consistent with the chord selected for the accompaniment.

21 Claims, 6 Drawing Sheets

(51) Int. Cl.
*G10H 1/00* (2006.01)
*G10H 1/46* (2006.01)
*G10H 5/00* (2006.01)

(52) U.S. Cl.
CPC ..... *G10H 1/46* (2013.01); *G10H 5/002* (2013.01); *G10H 2210/005* (2013.01); *G10H 2210/031* (2013.01); *G10H 2210/125* (2013.01); *G10H 2210/141* (2013.01); *G10H 2210/145* (2013.01); *G10H 2210/251* (2013.01); *G10H 2210/571* (2013.01); *G10H 2210/576* (2013.01); *G10H 2220/091* (2013.01); *G10H 2220/155* (2013.01); *G10H 2220/221* (2013.01); *G10H 2240/075* (2013.01); *G10H 2240/121* (2013.01); *G10H 2250/025* (2013.01)

(58) Field of Classification Search
CPC ..... G10H 2210/111; G10H 2240/131; G10H 1/365; G10H 2210/341; G10H 2210/005; G10H 2240/325; G10H 2210/571; G10H 1/0075; G10H 2220/221; G10H 2220/041
See application file for complete search history.

(56) References Cited

U.S. PATENT DOCUMENTS 5,990,407 A * 11/1999 Gannon ..... G10H 1/0025 84/604
6,093,881 A * 7/2000 Fay ..... G10H 1/0025 84/613
2007/0186752 A1 8/2007 Georges et al.
2007/0240559 A1* 10/2007 Hasebe ..... G10H 1/386 84/637
2010/0307321 A1* 12/2010 Mann ..... G06F 3/0481 84/613
2013/0025437 A1* 1/2013 Serletic ..... G10H 1/0025 84/634
2014/0053710 A1* 2/2014 Serletic, II ..... G10H 7/00 84/609
2014/0053711 A1* 2/2014 Serletic, II ..... G10H 1/38 84/611
2014/0083279 A1 3/2014 Little et al.
2014/0196592 A1* 7/2014 Bergman ..... G10H 1/38 84/613
2014/0352520 A1* 12/2014 Citron ..... G09B 15/00 84/470 R
2015/0013527 A1 1/2015 Buskies et al.
2016/0140944 A1* 5/2016 Bergman ..... G06F 3/041 84/613
2016/0148604 A1* 5/2016 Minamitaka ..... G10H 1/0025 84/613
2016/0148605 A1* 5/2016 Minamitaka ..... G10H 1/38 84/609
2016/0148606 A1* 5/2016 Minamitaka ..... G10H 1/0025 84/609

OTHER PUBLICATIONS

International Search Report, PCT/NO2016/050114, dated Sep. 13, 2016.
Written Opinion, PCT/NO2016/050114, dated Sep. 13, 2016.

* cited by examiner

METHODS, DEVICES AND COMPUTER PROGRAM PRODUCTS FOR INTERACTIVE MUSICAL IMPROVISATION GUIDANCE

CROSS-REFERENCE TO RELATED APPLICATIONS

This application is the U.S. national stage application of International Application PCT/NO2016/050114, filed Jun. 3, 2016, which international application was published on Dec. 8, 2016, as International Publication WO 2016/195510 in the English language. The International Application claims priority of Norwegian Patent Application No. 20150729, filed Jun. 5, 2015. The international application and Norwegian application are both incorporated herein by reference, in entirety.

FIELD OF THE INVENTION

The present invention relates to methods, devices and computer program products which allow users to compose or improvise their own melody assisted by appropriate recommendations and accompanied by suitable accompaniment.

BACKGROUND

Synthesizers and other electronic musical instruments have long been provided with a selection of electronically generated or pre-recorded rhythm tracks that provide guidance and accompaniment to the music played by the user. With the merger of computer assisted electronic instruments and virtual instruments generated by computer software, additional guidance has been provided, for example in the form of an indication of which key to press next in order to play, and learn, a specific (pre-programmed) melody, or which chord to play next in order to follow a specific chord progression.

Other tools make it possible to generate accompaniment or experiment with composition by designing a chord progression and selecting a rhythm pattern.

However, most of these solutions require either that a specific melody is pre-programmed to be followed exactly by the untrained player, or they allow users who already have some musical skills to compose and perhaps improvise freely on top of the composed chord progression. People that are not particularly musically sophisticated, or without the skill to improvise on a particular instrument, there are few alternatives that provide guidance, but at the same time leaves the user free to improvise. Consequently, there is a need for alternatives that provide assistance or guidance to a user without requiring pre-programming of a specific melody, but allows the user to play and improvise freely.

SUMMARY OF THE INVENTION

The present invention provides the inventive concept of a device which may be partly implemented in specialized or general hardware, partly in software, and which provides a user with the ability of freely improvising or playing around with a selection of different chords and be provided with visual guidance assisting the improvisation of melody, while also providing accompaniment consistent with the selection of chords.

According to a first aspect of the invention, a method is provided wherein, in an electronic device, a user is provided with accompaniment and improvisation guidance. The method provides a user interface with a first user interface element allowing a user to select among a plurality of chords, and a second user interface element representing a keyboard from which a user can play a selection of notes. Based on a current selection, made by the user, of one of the plurality of chords, at least one sound file from an audio data library is played, and at the same time the second user interface is adapted to emphasize at least a triad of notes belonging to the currently selected chord. Upon receipt of a user input representing selection of a next chord, the method will wait until a well-defined point in time to terminate playback of the at least one sound file selected based on the currently selected chord, commence playback of at least one sound file from the audio data library, the selection of which being based on the selection of a next chord, and update the second user interface element to emphasize at least a triad of notes belonging to the next chord.

The well-defined point in time can be defined by the beat of the music of the sound file being played. In this manner, chord changes will take place in a manner that is consistent with the music being played, even if the user is unable to determine an appropriate point in time on his or her own, or unable to provide input to that effect at the appropriate point in time. The well-defined point in time can, for example, be at the completion of a currently playing bar. However, other alternatives are possible, in other embodiments of the invention, as a user selectable option, or as a selection made during the production of a particular set of sound files (referred to in this description as a preset). In some cases it may for instance be preferable to define the well-defined point in time as at the completion of a predetermined number of bars, for example two bars, in order to give the user more time. This may particularly be if each bar is of a short duration, for example in music with a high tempo.

However, the opposite may also be the case, so embodiments may also operate with a well-defined point in time which is at the completion of a predefined number of beats into the currently playing bar, or according to some other well defined subdivision of a bar.

In some embodiments, the first user interface element, or an additional user interface element, is configured to always identify a currently selected chord.

A number of different ways of emphasizing a triad of notes may be contemplated. In some embodiments, the at least a triad of notes is emphasized by being represented by larger keys than the notes that are not emphasized. In other embodiments the at least a triad of notes is emphasized by being represented by keys with a symbol superimposed on them. The at least a triad of notes may also be emphasized by their color, including illumination or brightness.

In some embodiments the user interface is a graphical user interface provided on the display of the electronic device. The method according to the invention may thus be adapted or configured to operate on a generic electronic device such as a smartphone, a tablet computer, a laptop or desktop computer, for example one with a touch screen input device.

According to one embodiment, the second user interface element is a representation only of the keys associated with the scale of a currently selected musical key. This simplifies the selection of suitable notes and may be preferable to a less sophisticated user. In another embodiment the second user interface element is a chromatic keyboard, such as a representation of a piano type keyboard, which is less restrictive and may be preferred by more sophisticated users.

However, in accordance with the principles of the invention, the second user interface element may also be a physical keyboard, and the at least a triad of notes can be emphasized by a light emitted adjacent to or embedded in the keys of the keyboard.

Substantially the same aspect of the invention may be provided in the form of an electronic device for providing a user with accompaniment and improvisation guidance. Such a device may include a sound system module, a synthesizer module, an audio data library, a chordlooper, and a user interface module. The user interface module can be configured to provide a user interface with a first user interface element allowing a user to select among a plurality of chords, and a second user interface element representing a keyboard from which a user can control the synthesizer module to play a selection of notes through the sound system module. The chordlooper can be configured to receive user input from the first user interface element identifying a selected next chord, and upon receipt of such user input, wait until a well-defined point in time to terminate playback through the sound system of any sound file selected from the audio data library based on a currently selected chord, commence playback through the sound system of at least one sound file selected from the audio data library, the selection of which being based on the received user input identifying a selected next chord, and instruct the user interface module to update the second user interface element to emphasize at least a triad of notes belonging to the selected next chord.

The electronic device may further comprise a memory area configured to temporarily store sound files in a queue to be played by the sound system, and into which the chordlooper is configured to enter sound files from the audio data library. It will be understood by those with skill in the art that the memory area does not have to be a specific part of hardware memory. It may also be permanently or dynamically allocated in accordance with how the electronic device otherwise manages memory or allows installed programs to manage memory.

The well-defined point in time may be defined as already describe above.

According to another aspect of the invention, a method in an electronic device is configured to provide a user with musical accompaniment. The method includes providing a user interface with a first user interface element allowing a user to select among a plurality of chords, a second user interface element representing a keyboard from which a user can play a selection of notes, and a third user interface element allowing a user to select among a plurality of dynamic levels. Based on a current selection of one of the plurality of chords and a current selection of dynamic level, at least one sound file from an audio data library is played. Upon receipt of a user input representing selection of at least one of a next chord and a next dynamic level, the method waits until a well-defined point in time and then terminates playback of the at least one sound file selected based on the currently selected chord and the currently selected dynamic level, and commences playback of at least one sound file from the audio data library, the selection of which being based on the selection of a next chord.

The well-defined point in time can be defined as described above.

According to some embodiments, the at least one sound file includes a plurality of sound files selected to be played simultaneously. Such a plurality of sound files may include a first sound file representing a bass track, a second sound file representing a chord track, and a third sound file representing a percussion track. The bass track may thus be provided as the playback of a recording of the accompaniment of for example a bass guitar or some other suitable instrument, while the chord track may be similarly provided as the recording of the accompaniment of a rhythm guitar, a piano or some other musical instrument or instruments capable of providing basic chord based accompaniment in accordance with the selected chord and dynamic level. The percussion track may be based on recordings of percussive instruments such as drums.

The first sound file representing a bass track, and the second sound file representing a chord track may thus both be selected based at least on the currently selected chord and the currently selected dynamic level, and the third sound file representing a percussion track is selected based at least on the currently selected dynamic level.

The plurality of sound files may include a fourth sound file representing a transitional track, selected at least based on a selection of a next dynamic level and a selection of a next chord. It is, however, in accordance with the principles of the invention to add even further additional tracks.

An electronic device in accordance with the second aspect of the invention may be configured for providing a user with accompaniment and improvisation guidance and include a sound system module, a synthesizer module, an audio data library, a chordlooper, and a user interface module. The user interface module according to this embodiment, is configured to provide a user interface with a first user interface element allowing a user to select among a plurality of chords, a second user interface element representing a keyboard from which a user can control the synthesizer module to play a selection of notes through the sound system module, and a third user interface element allowing a user to select among a plurality of dynamic levels. The chordlooper is configured to receive user input from the first user interface element identifying a selected next chord, and upon receipt of such user input, wait until a well-defined point in time to terminate playback of any sound file selected based on a currently selected chord, and commence playback of at least one sound file from the audio data library, the selection of which being based on the received user input identifying a selected next chord.

The electronic device may further include a memory area as described above. Also, the well-defined point in time may be defined as described above.

In some embodiments the at least one sound file may include a plurality of sound files selected to be played simultaneously, and the memory area may be configured to temporarily store sound files in a plurality of tracks. The plurality of sound files may include a first sound file representing a bass track, a second sound file representing a chord track, and a third sound file representing a percussion track, as already described. A fourth sound file representing a transitional track, selected at least based on a selection of a next dynamic level and a selection of a next chord, may also be included, as also described above.

According to the invention, computer program products are also provided. In particular, a computer program product stored on a computer readable medium and including instructions which will allow an electronic device to perform a method implementing aspects and embodiments of the invention. The computer readable medium may be any such medium known in the art, including flash drives, magnetic drives, CD-ROM, DVD-ROM, etc.

BRIEF DESCRIPTION OF THE DRAWINGS

The invention will now be described in further detail in the form of exemplary embodiments, and with reference to the drawings, where.

DETAILED DESCRIPTION

Figure 1:
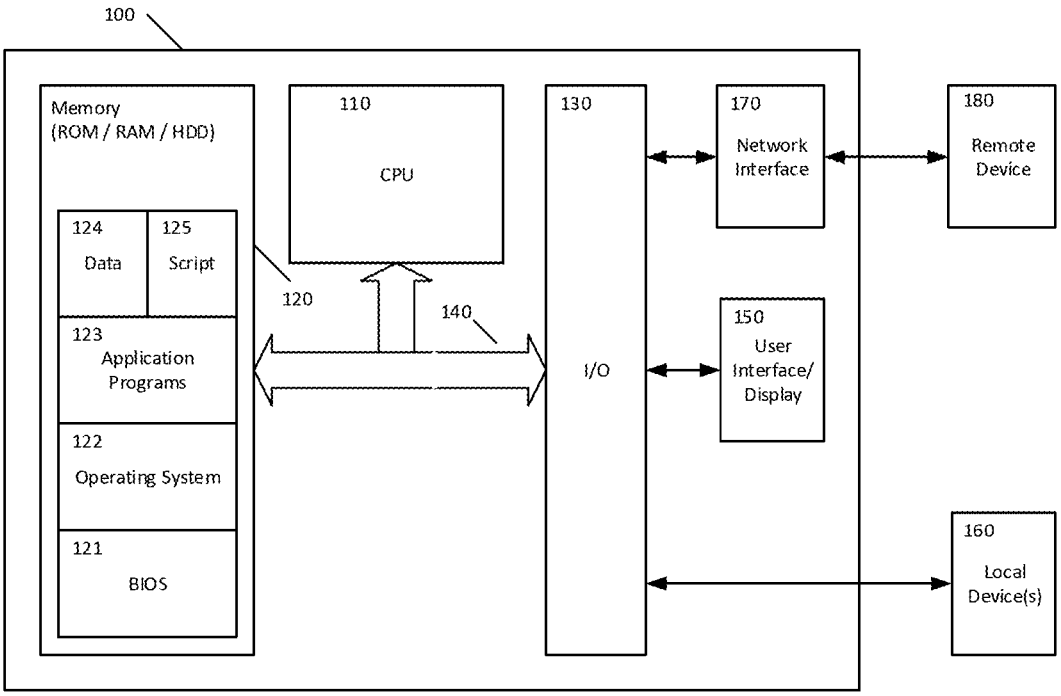
FIG. 1 is a generalized computing device that can be used for implementing various aspects of the invention.

In the following description of various embodiments, reference will be made to the drawings, in which like reference numerals denote the same or corresponding elements. It should be noted that, unless otherwise stated, different features or elements may be combined with each other whether or not they have been described together as part of the same embodiment below. The combination of features or elements in the exemplary embodiments are done in order to facilitate understanding of the invention rather than limit its scope to a limited set of embodiments, and to the extent that alternative elements with substantially the same functionality are shown in respective embodiments, they are intended to be interchangeable, but for the sake of brevity, no attempt has been made to disclose a complete description of all possible permutations of features.

Furthermore, those with skill in the art will understand that the invention may be practiced without many of the details included in this detailed description. Conversely, some well-known elements or functions may not be shown or described in detail, in order to avoid unnecessarily obscuring the relevant description of the various implementations. The terminology used in the description presented below is intended to be interpreted in its broadest reasonable manner, even though it is being used in conjunction with a detailed description of certain specific implementations of the invention.

FIG. 1 illustrates a generalized computing device 100 that can be used as an environment for implementing various aspects of the present invention. In FIG. 1, a device 100 has various functional components including a central processor unit (CPU) 110, memory 120, an input/output (I/O) system 130, all of which communicate via a system bus 140. The input/output system 130 handles communication with the environment, for example over an integrated user interface and display 150, with local devices 160 such as for example a keyboard, a mouse, an external monitor, loudspeakers etc. The I/O 130 may also be connected to a network interface 170 which communicates over a computer network using standardized protocols including Ethernet, Wi-Fi, a cellular network or any other local or wide area network, as is well known to those with ordinary skill in the art. Using the network interface 170 the device 100 may be able to obtain data, software or services from a remote device 180, for example from a server connected to the Internet.

The memory 120, which may include ROM, RAM, flash memory, hard drives, or any other combination of fixed and removable memory, stores the various software components of the system. The software components in the memory 120 may include a basic input/output system (BIOS) 121, an operating system 122, various computer programs 123 including applications and device drivers, various types of data 124, and other executable files or instructions such as macros and scripts 125.

The communication with local devices 160 such as user input devices, a printer, a media player, external memory devices, and special purpose devices, for example, an instrument keyboard, may be based on any combination of well-known ports such as USB, MIDI, DVI, HDMI, PS/2, RS-232, infra-red (IR), Bluetooth, printer ports, or any other standardized or dedicated communication interface for local devices.

A video interface may be part of an integrated user interface and display combination 150 in a manner which is typical for smartphones, tablet computers and similar devices. Alternatively, a monitor may a local device 160. In either case, the display may have a touch sensitive screen and, in that case, the display unit doubles as a user input device.

The network interface device 170 provides the device 100 with the ability to connect to a network in order to communicate with an external server and other remote devices 180. The remote device 180 may in principle be any computing device providing services over a network, but typically be a web server providing software or media files over the World Wide Web.

It will be understood that the device 100 illustrated in FIG. 1 is not limited to any particular configuration or embodiment regarding its size, resources, or physical implementation of components. For example, more than one of the functional components illustrated in FIG. 1 may be combined into a single integrated unit of the device 100, or conversely be implemented as several components. For example, the CPU may be a single CPU, a single CPU with multiple cores, or several CPUs. The system bus 140 may include a data bus, and address bus and a control bus. Also, a single functional component of FIG. 1 may be distributed over several physical units. Other units or capabilities may of course also be present. Furthermore, the device 100 may, e.g., be a general purpose computer such as a PC, or a personal digital assistant (PDA), or even a cellphone or a smartphone, or it may be implemented in a special purpose musical device, for example a synthesizer with a piano type keyboard.

Similarly, the implementation of the software components (or hardware/software combinations) may vary from that illustrated in FIG. 1. Many modern platforms include additional layers wherein for example services, media libraries and virtual machines are built on top of a core operating system, and where applications may be implemented in a script language or some other language running inside a virtual machine, or even as a web application running inside a web browser. In such an environment it may be difficult to distinguish strictly between operating system 122, application programs 123 and scripts 125, but those with skill in the art will understand that the example illustrated in FIG. 1 is conceptual and intended to facilitate understanding of the invention and the type of context in which it can be implemented, not to provide a strict definition of a particular software architecture.

An application program 123*a* installed on a device 100 and residing, for example, as computer code instructions in memory 120 may enable the device 100 to operate in accordance with the principles of the invention. In one embodiment the application program may be configured as a number of software modules in the architecture illustrated in FIG. 2. The application may include a sound system module 200, although the sound system may also be part of the functionality that is already part of the device 100, or functionality may be divided between several modules both in software and hardware. The application according to this embodiment furthermore includes a synthesizer module 210, for example a sample based synthesizer with a library of sounds representing a specific instrument and additional functionality such as envelope, addition of reverb and other sound effects. This functionality may or may not be accessible for the user to adjust, and is not part of the invention as such. Other types of synthesizers are also possible, as will be readily apparent to those with skill in the art.

The synthesizer may be played by a user by way of a keyboard module 220. The keyboard module 220 includes a user interface part which will be described in further detail below. Based on input from a user the keyboard module 220 instructs the synthesizer 210 which sounds to play, and—to the extent this is implemented as part of the keyboard and synthesizer features—whether to apply any particular effects, change the envelope of the sound, etc. For example, some sound libraries, for example a library representing an organ, may play a sound as long as the user presses a particular key, while other sound libraries, for example one representing a piano, may have a specific duration. In general this behavior can be defined as an envelope which defines contour of the sound amplitude. Typically the contour includes four phases, referred to as attack, decay, sustain and release.

In addition to the synthesizer module 210, the application according to this embodiment includes an audio data library 230. This audio data library 230 is a library of sound files which can represent different tracks of accompaniment, such as bass, percussion, and chords. In other embodiments this module may generate the accompaniment by other means than selection and playback of sound files, for example by a number of well-known methods for generating synthetic music and sound. The audio data library will be described in further detail below.

The audio data library 230 operates under control of a chordlooper 240. The chordlooper selects sound files for playback from the audio data library 230 in accordance with which chord a user has chosen using a chord selector input module 250, and places them in a queue of sound files to be played by the sound system 200. The chord selector input module 250 may be capable of receiving input identifying a selected key, and to generate user interface elements representing the chords that are selectable when playing in this key. The default chord that is delivered from the chord selector input module 250 to the chordlooper 240 is the tonic chord of the selected key. This chord will be used by the chordlooper 240 until the user selects a different chord using the appropriate user interface elements generated by the chord selector input module 250.

According to some embodiments, the user may also select a dynamic using a dynamic selector input module 260. The selected dynamic will influence the chordlooper's 240 selection of sound files from the audio data library 230. This will be described in further detail below.

Figure 2:
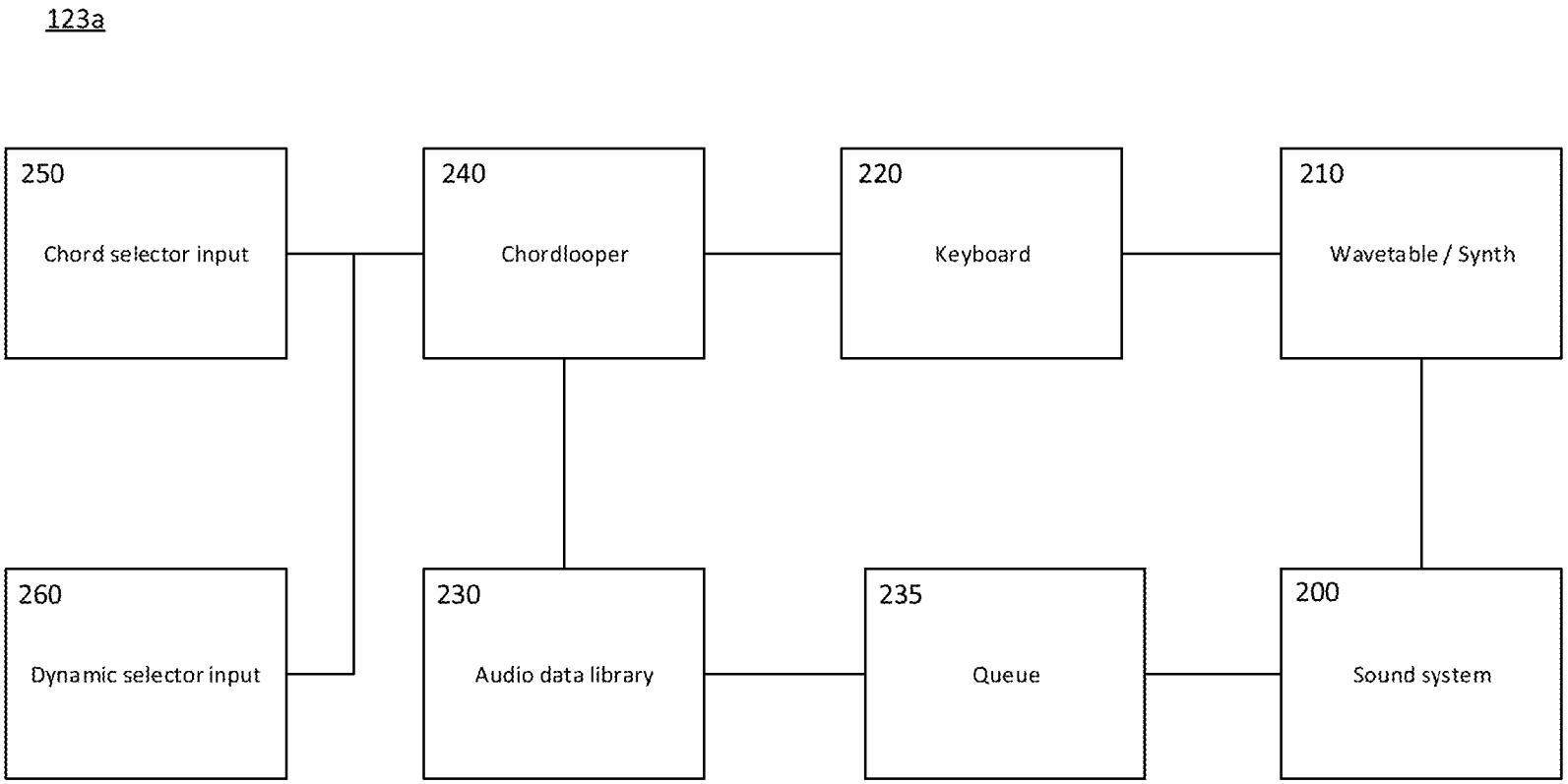
FIG. 2 is an example of a modular software architecture according to some embodiments of the invention.

FIG. 2 does not include any explicit user interface module. In this embodiment it is assumed that the various modules are able to generate user interface elements or other forms of visual information using the capabilities of the underlying services, virtual machines, operating system, drivers etc., and to receive input from a user in a similar manner. However, it is consistent with the principles of the invention to include a user interface module as well as other modules in the application 123*a* in addition to those shown in the drawing.

Figure 3:
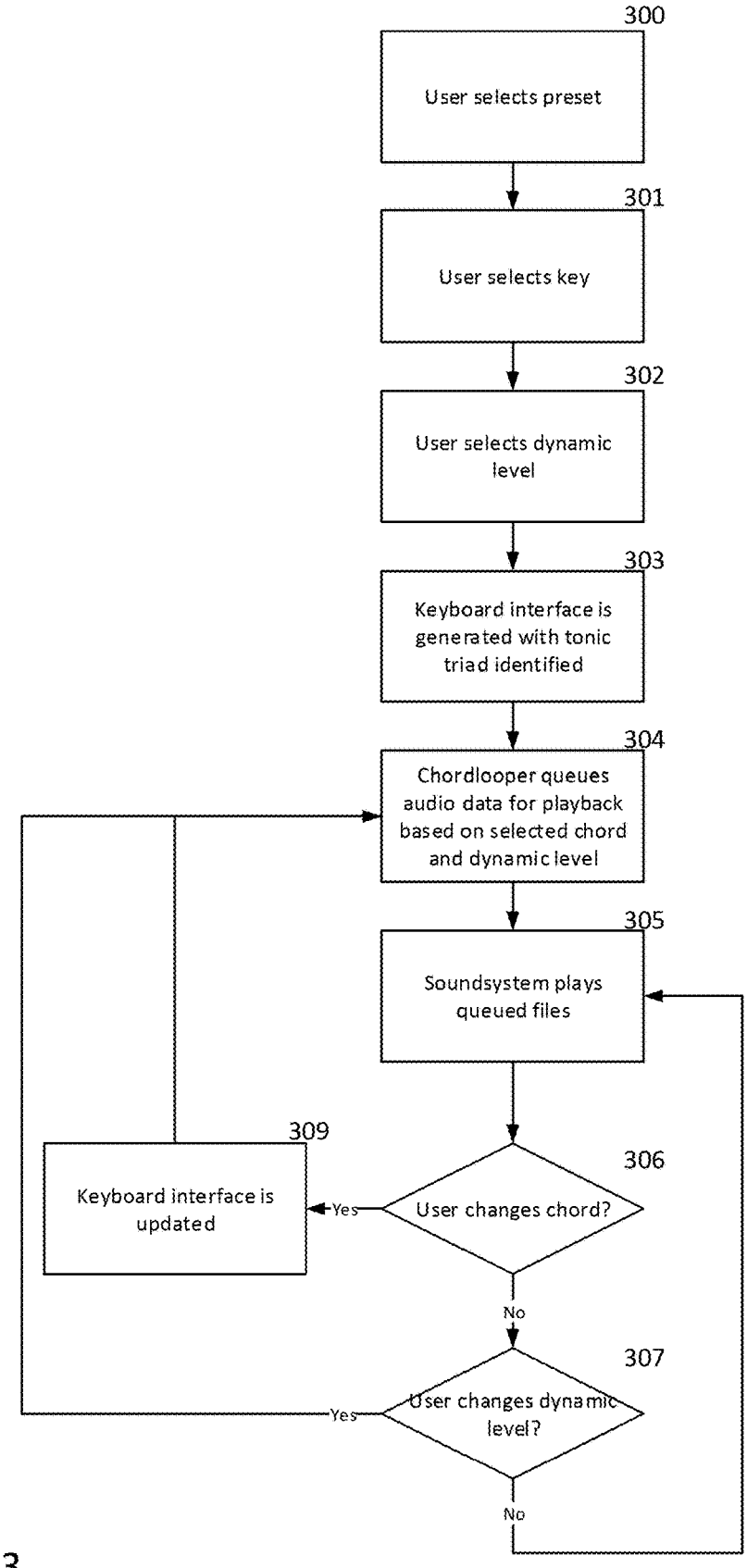
FIG. 3 is a flow chart illustrating a method according to the invention.

Reference is now made to FIG. 3, which is a flowchart illustration of how a device representing an embodiment of the invention may operate.

A user is presented with a user interface which includes controls which may be generated by the audio data library 230 or some other module of the application 123*a*. These controls may allow the user to select a preset in a first step 300. A preset may, for example, represent a certain musical genre, a set of instruments etc., and includes the library of sound files that will be loaded into the audio data library 230. The preset may also include the settings for the synthesizer module 210. In some embodiments of the invention, the application 123*a* includes the capability of accessing and downloading new presets, for example in the form of what is often referred to as "in app purchases" or other downloads from a remote device 180 using the network interface 170.

Once the preset has been loaded in step 300, the user may further have the ability to use a user interface element to select a key in step 301. In principle, any number of keys and modes can be made available. For most practical and commercial purposes, limiting the available selections to all or a subset of the standard major and minor keys, and the examples provided below will be limited to this without loss of generality. The selection of a key will also represent the selection of the tonic chord of that key as the first chord that will be delivered as input from the chord selector module 250 to the chordlooper 240 once play commences.

The selection of preset and key may be part of a different user interface than that which is presented to the user during play. One possibility is to give the user access to a menu for making these selections, as well as others such as for example volume, tempo, envelope, synthesizer instrument etc. A very basic example of how the user may select envelope is to simply allow the user to choose between sustained tones—tones that last until the user releases its corresponding button on the keyboard—and released tones that end according to a predefined envelope independent of if and when the user releases the key. Another option is to use a specific startup screen where these selections are made prior to pushing a start button.

In a following step 302 the user selects dynamic level. This selection may be part of the setup screen described above, but it may also or exclusively be available directly from the user interface during play, as will be described below. The selection of dynamic level is done using a user interface element generated by the dynamic selector input module 260, which uses the selected input to influence the way the chordlooper module 240 selects tracks from the audio data library 230. The dynamic level may also influence the settings of the synthesizer module 210, for example by adjusting the volume or the shape of the envelope.

The dynamic level may also start at a default level and be available for adjustment by the user during play. It is also consistent with the principles of the invention to design embodiments that do not include the ability to change between several dynamic levels, but which includes other aspects of the invention.

After initial settings have been made, the keyboard part of the interface is generated or adapted accordingly, primarily by indicating which keys represent the tonic triad of the key. This is done in step 303, a step which in principle may be performed at any time after the user has selected the key in step 301 (i.e. step 303 may be performed before or after the user's selection of dynamic level).

Based on the selections initially made by the user, the chordlooper 240 will, in step 304, select audio data files from the audio data library 230 and enter them in a memory area of the device 100 representing a queue 235 of sound files to be played by the sound system 200. The selection can be made based on the key and the dynamic level, and may consist of one or more sound files that can be played in parallel. Examples of multitrack accompaniment will be given in further detail below.

In step 305 the sound system 200 plays the queued files. If the user does not change the chord in step 306 and not the dynamic level in step 307, the same queued files will be played again in a return to step 305. However, in other embodiments of the invention control may return to the chordlooper 240 in step 304 after the queued files have been played, and the chordlooper 240 may select alternative sound files to be queued provided that the audio library 230 includes alternative files for a given combination of chord and dynamic level. For the sake of simplicity, the following description will assume that the same sound files are played repeatedly until the user changes chord or dynamic, but this is not intended to be understood as a limitation on the scope of the invention.

If the user changes chord in step 306 by invoking the appropriate user interface elements as will be described further below, the keyboard interface elements are updated in step 309 by changing the identification of a triad from that of the currently playing triad to the triad of the chord selected by the user in step 306. However, this change may not take effect immediately. Instead, control returns to the chordlooper 240 in step 304 and the chordlooper 240 selects new sound files from the audio data library 230 and enters them in the queue for playback by the sound system 200. As soon as the sound system starts playing the new sound files in step 305 the user keyboard update generated in step 309 takes effect.

Similarly, if the user changes dynamic level in step 307, that information is delivered as input to the chordlooper 240 in step 304 and sound files representing the change in dynamic level are selected from the audio data library 230 and entered into the playback queue.

It should be noted that while the flow chart illustrated in FIG. 3 gives the impression that the selection of dynamic level is something that becomes available to the user if the user chooses not to change chord in step 306, the user interface may continuously present the controls enabling the user to make these changes, and the user may have both changes take effect at the same time.

In some embodiments the sound files selectable from the audio data library 230 represent a sequence of music continuing for one or two bars. This sequence will be played in a loop (illustrated as the return to step 305 in the flowchart) until the chordlooper 240 receives input representing a change of chord from the chord selector input module 250 and/or the dynamic level selector input module 260. When the chordlooper 240 selects new sound files for playback, the newly selected files will be queued after the currently playing files, which means that the change of chord or dynamic level does not take effect until at the end of the current or the next bar, if the currently selected files are one or two bars long.

In alternative embodiments the audio data library 230 does not include complete loops, but samples which can be used to generate loops, either by a user operating an editor module or automatically by the chordlooper 240. Generation of loops from samples may be based on techniques that are well known in the art and will not be described in detail. Generally speaking the audio data library may include sound files that either already constitute complete loops, or that can be used to create complete such loops using techniques that are not part of the invention as such.

One exception to the rule that chord changes and changes in dynamic level do not take effect until after the end of the currently playing bar (or the next bar if sound files are two bars long), exists in some embodiments of the invention. One of the tracks of the accompaniment may be empty most of the time and only filled with specific sound effects that will be played immediately prior to a change in dynamic level or in chord. An example can be cymbal hits or drum fills that will immediately precede specific changes in dynamic level according to specific rules. This will be described in further detail below.

It should also be realized that in some embodiments chord changes can take place after a certain number of beats into a chord, for example after 2 of 4 beats in 4/4 meter. Other possibilities may be contemplated, and in some embodiments this may be part of the setting of a given preset.

Referring to FIG. 4, a first exemplary embodiment of a user interface consistent with the principles of the invention is illustrated. Various user interface elements may be generated by, or at least provide interaction with, different of the modules shown in FIG. 2, as described above. FIG. 4 shows three different views of the same interface and the same reference numerals refer to the same user interface elements in the three views.

The three views all show a device 401 with a display 402, which may be a touch screen. The display 402 shows a user interface including an icon 403 representative of a drop down menu for access to additional settings, a user interface element 404 for selection of a live mode, a corresponding user interface element 405 for selection of a studio mode and a record button 406. Selection of studio mode 405 will change the user interface in order to allow a user to preprogram music sequences. This mode will not be discussed in further detail herein. The record button will store the music that is played in live mode. The recorded music may later be edited in studio mode. Recording of music sequences will not be discussed in further detail herein.

When a user starts the application, a selection of preset (genre) and key may be made initially. When this is done, the user interface shown in FIG. 4 is adapted to the selection of key in that the tonic of that key determines the first chord that will be selected by the chordlooper 240, and this is shown as the currently playing chord 407. In the example shown in FIG. 4 the selected key is A-minor. The user interface also provides a graphical indication 408 of the time that remains of the currently playing bar.

Below the indication of the currently playing chord 407 and time remaining of the current bar 408 is a representation of selectable chords 409. The selected key is also indicated as the leftmost of the selectable chords, in this case A-minor. In this example one selectable chord is represented for each note in the scale of the selected key, Am, B°, C, Dm, Em, F and G. The invention is not limited to this selection, and could make additional or fewer chords selectable during play. The user interface element representing selectable chords 409 is generated by, or at least in communication with, the chord selector input module 250.

Below the selection of chords is a representation of a keyboard, which in this case is a sequence of circles 410. Each circle represents a note in the scale of the selected key, starting and ending with the tonic of that key.

Figure 4A:
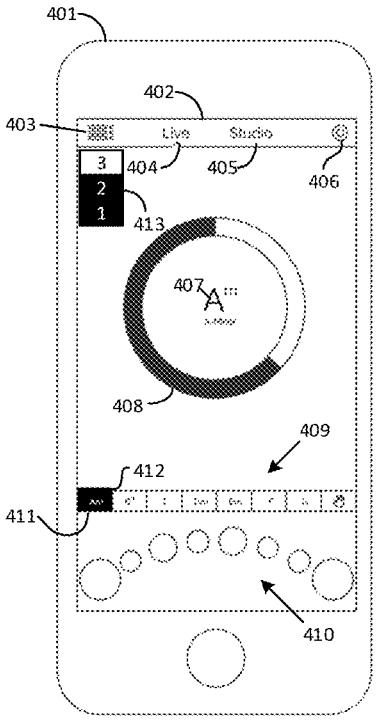
FIG. 4 is an illustration of three views of a first exemplary embodiment of a user interface consistent with the invention.

In FIG. 4A the current chord is A-minor, as indicated at user interface element 407. This is also indicated in that the representation of A-minor 411 is shown with a different background color than the other chords in the representation of selectable chords 409. Above the representation of A-minor 411 is an indication 412 representing the next chord to be played. In this case the two indications 411, 412 both identify A-minor, which means that after the current bar has finished, A-minor will be played again.

Figure 4B:
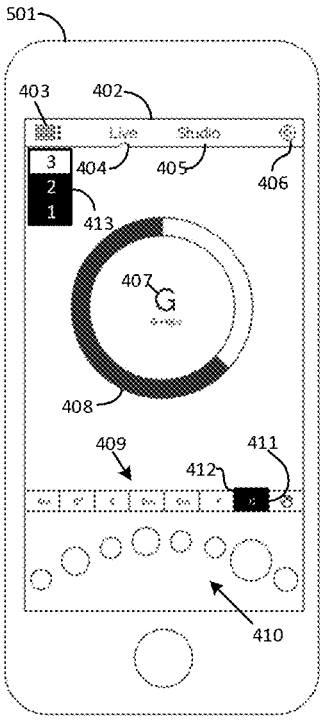

In FIG. 4B the user interface elements are the same and the key is still A-minor, as indicated by A-minor being the leftmost selectable chord in chord selection element 409, but the currently playing chord is G, as indicated by the current chord indication 407 as well as the contrasting background color of the user interface element representing the currently selected chord 411 has moved to the representation of the G-chord. Again the next chord 412 is the same as the current chord 411.

Figure 4C:
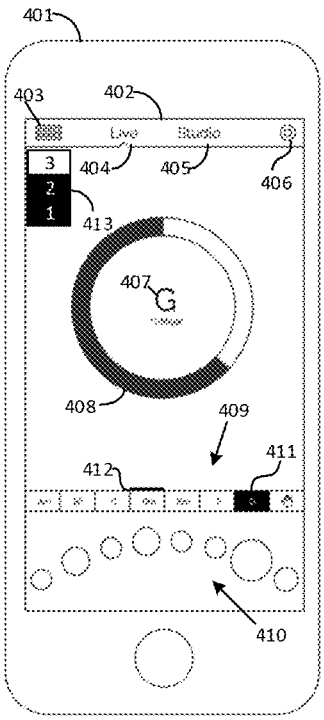

In FIG. 4C the currently playing chord is still G, as indicated at user interface elements 407 and 411, but user has selected D-minor as the next chord to be played. This selection has been communicated from the user interface to the chord selector input 250 which instructs the chordlooper 240 to select corresponding sound files from the audio data library 230 and queue them for playback by the sound system 200 starting with the next bar.

In FIG. 4A the currently playing chord was A-minor. As an aid to the user, this is reflected also in the keyboard part 410 of the user interface in that the keyboard elements representing the triad of an A-minor chord are larger than the remaining notes' keyboard elements. In the illustrated embodiment the keyboard elements representing the root of the chord, in this case A, are the two large circles at the leftmost and rightmost position. The rightmost circle represents A an octave above the leftmost circle. The third and the fifth of the A-minor chord are represented as circles larger than the remaining notes, but slightly smaller than those representing the tonic. According to the embodiment illustrated in FIG. 2, the keyboard module 230 generates, or at least is in communication with, the keyboard user interface elements 410.

It should be noted that in the embodiment illustrated in FIG. 4, the circles 410 represent the notes that are present in the scale of the current key, which in the case of FIG. 4 is A-minor. This may be the case even if the current chord is a chord which includes notes not represented in the scale. However, in alternative embodiments the keyboard may adapt to the chord currently being played and replace or add circles to include additional notes. Furthermore, using two different sizes to identify the root, the third and fifth, and the remaining notes, respectively, is only one possible embodiment. An alternative is to use only two different sizes, to identify the triad only but without distinguishing the notes in the triad from each other. Additional alternatives are possible, and the use of sizes can be replaced or further augmented by use of symbols or colors to provide additional information.

The keyboard module 220 receives information from the chordlooper 240 regarding the currently playing chord and updates the keyboard accordingly. In FIG. 4B and FIG. 4C the currently playing chord has changed to G, as described above. Consequently, the keyboard module 220 has updated the keyboard user interface elements 410 such that the largest circle is now the circle representing G, the root of the currently playing chord. The circles representing the third and the fifth, in this case B and D, are enlarged, but smaller than the G circle.

While playing, the user is able to use all the notes represented by the user interface keyboard element 410, but guidance is provided in form of the enlarged circles, since playing notes that are part of the currently playing chord will not be disharmonic. The user may experiment with additional notes, and more experienced users may desire to be able to select all the chromatic notes, as will be described below.

Interface elements representing the dynamic levels can be displayed at all times, for example as three buttons 413. (Alternatively, a user could access the three buttons as a part of a drop down menu invoked by icon 403.)) The selected level is indicated, for example by having a different background color or shading than the other levels, and the levels themselves are identified by numbers, but other symbols or for example colors may also be used. This user interface element 413 is generated by, or at least in communication with, the dynamic selector input module 260. When the user changes dynamic level using this menu 413, this user input will be communicated to the dynamic selector input module 260 which will instruct the chordlooper 240 to select and queue sound files from the audio data library 230 in accordance with the new level. In addition to selecting sound files for the following bar, in some embodiments of the invention the chordlooper will select sound files that will be played at the end of the currently playing bar when dynamic level is changed.

Reference is now made to FIG. 5, which shows three views corresponding to those in FIG. 4. In order to avoid unnecessary clutter and repetition, the user interface elements that are repeated from FIG. 4, but that will not be discussed with reference to FIG. 5 are not given reference numbers in FIG. 5.

Figure 5A:
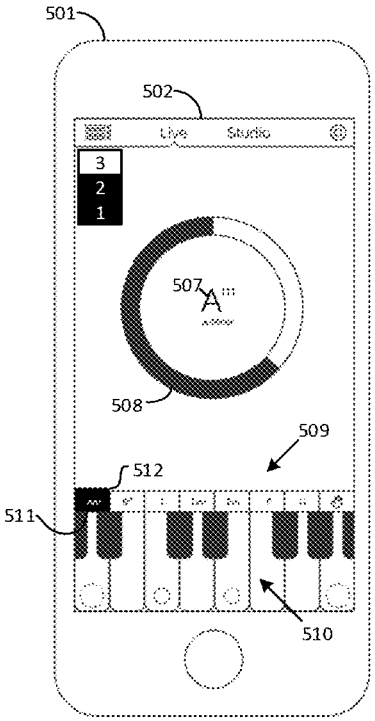
FIG. 5 is an illustration of three views of a second exemplary embodiment of a user interface consistent with the invention.
Figure 5B:
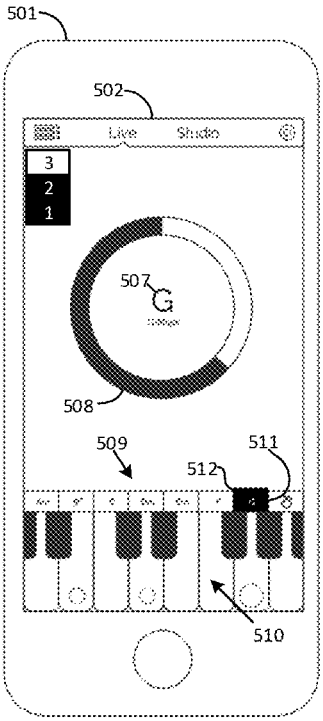
Figure 5C:
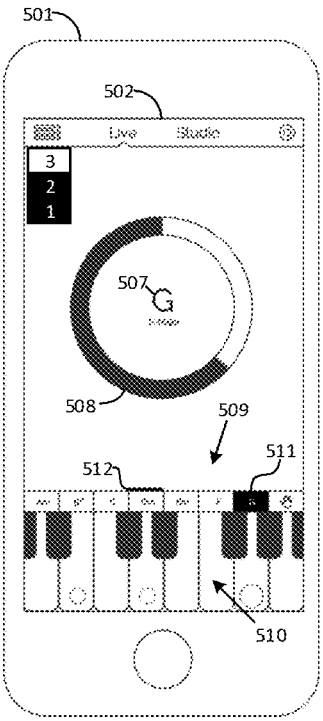

A device 501 with a user interface 502, which again may be a touch screen, shows a currently playing chord 507 and time remaining of the currently playing bar 508. These elements along with the user interface elements for selecting chords 509 and indicating current selected chord 511 and next selected chord 512 are the same in all three views FIG. 5A, FIG. 5B and FIG. 5C, as in FIG. 4. In FIG. 5, however, the keyboard user interface element 510 is now of the familiar piano keyboard type, allowing the user to play all the chromatic notes of an octave starting with the tonic of the selected key. In addition, the triad of the currently playing chord is identified by dashed circles on the corresponding keys. These will be easily identified in the drawing, but in order to avoid unnecessary clutter they are not given reference numbers. In FIG. 5A the root of the chord, A, is identified by large dashed circles, and the third and fifth are identified by smaller dashed circles. In FIG. 5B and FIG. 5C it is the triad of G that is so identified. The identification is controlled by the keyboard module 220 which is updated by the chordlooper 240 regarding which chord is the current chord.

Instead of dashed circles, any convenient graphic representation suitable to distinguish keys from one another, including, but not limited to, graphical shapes or symbols, alphanumeric symbols, and color. It is also possible to vary the extent of information provided. In the illustrated example the root is distinguished from the third and the fifth of the chord by being identified by a slightly larger dashed circle. Alternatively, the triad could be identified with circles of the same size (or otherwise identical symbols), or the representation could include additional information, for example by also distinguishing the third from the fifth.

The identification of the chord's triad will change if and when the bar has come to an end, as indicated by 508 and a different chord starts playing, as indicated by 507 and 511. In this case, the selection of chords 511 and indication of next selected chord 512 may be lined up with the key representing their respective root notes on the keyboard 510.

In other embodiments, not only the triad, but additional notes in the chords scale may be identified, ranging from notes included in, e.g. an augmented chord, to all the notes in the scale. It will be understood by those with skill in the art that this requires a chromatic keyboard, as shown in FIG. 5. A corresponding embodiment using a keyboard such as the one illustrated in FIG. 4 would require dynamic addition and removal of keys that are part of the current chord but not part of the key represented by the keyboard.

FIG. 6 is a drawing closely corresponding to that of FIG. 5, with a device 602 with a display, which again may be a touchscreen. Again, a currently playing chord is indicated 607 along with the progression of the bar 608. Also selection of chords 609 is similar, with an indication of currently selected 611 and next selected 612 chords.

Figures 6A, 6B, 6C:
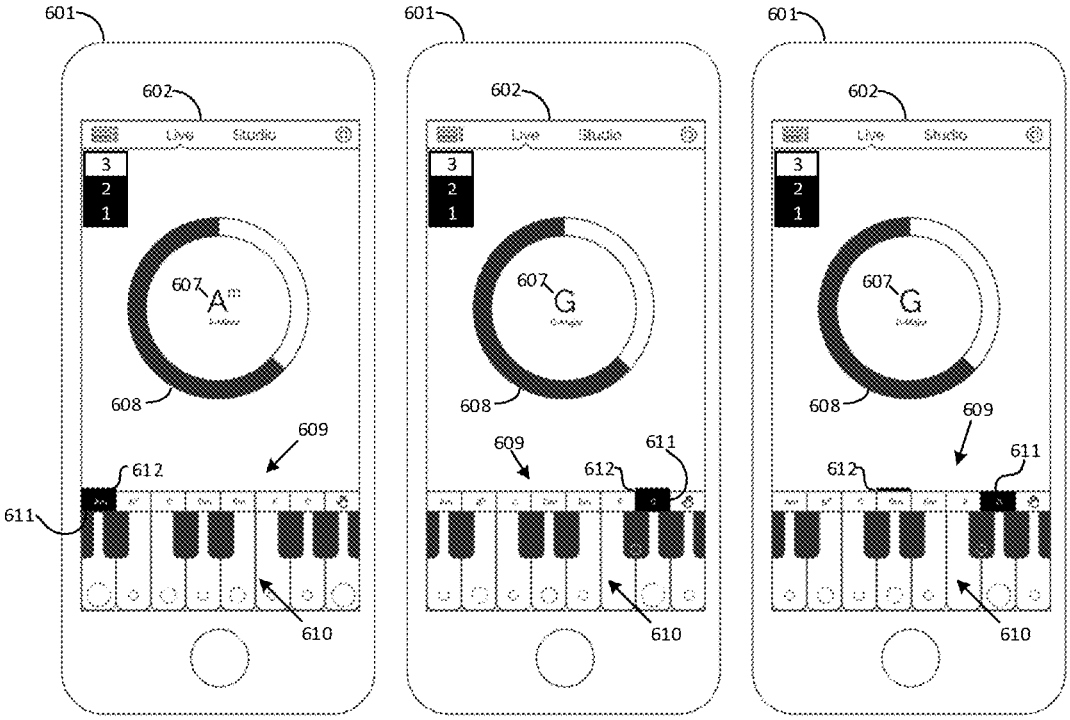
FIG. 6 is an illustration of three views of a third exemplary embodiment of a user interface consistent with the invention.

In this case the indications on the keyboard include dashed circles of three sizes. The root of the current chord is indicated as large circles, the third and fifth of the chord are indicated as medium size circles, and the remaining notes of the scale corresponding to the current chord are shown as small circles. This can be seen by noting that in FIG. 6A, the A-minor scale is identified, while in 6B and 6C the G-major scale is identified. This will provide additional guidance to a user. This means that in this embodiment, notes that are never displayed at all in the embodiment of FIG. 4 will not only be displayed (as in the embodiment of FIG. 5), but also be identified as recommended by a dashed circle. In FIGS. 6B and 6C this is exemplified by the recommendation of F-sharp, which is part of the scale associated with the current chord, G-major, even if it is not part of the current key, which is still A-minor.

It will be realized by those with skill in the art that additional possibilities are consistent with the principles of the invention. For example, the recommended notes may be notes that are part of the currently played chord, but not all the notes of the chords associated scale. Also, the weight given each recommendation, in the examples illustrated by the size of the circles, could include additional or fewer degrees, and based on additional criteria. Just one example could be to differentiate between the third and the fifth, for example by making the third larger than the fifth, but smaller than the root.

It will be realized that the various user interface elements described above can be configured differently, for example by having different positions on the screen, different shape, color and layout, etc. Also, it will be realized that the current key indication 407, 507, 607 and the currently selected chord 411, 511, 611 essentially provide the same information and can be combined into one. Furthermore, the display 402, 502, 602 may equally well be a separate monitor and the user input may be provided using one or more additional input devices such as a mouse, an alphanumeric keyboard, and a synthesizer keyboard or some other hardware keyboard interface device. If a hardware keyboard is provided, the keyboard user interface element 410, 510, 610 may still be part of the display on the screen in order to provide indication of notes considered compatible with the currently playing chord. However, the keyboard user interface element may be omitted, provided that the hardware keyboard is capable of being controlled by the keyboard module 220 to identify recommended keys, for example by light from inside or adjacent to each key.

Figure 7:
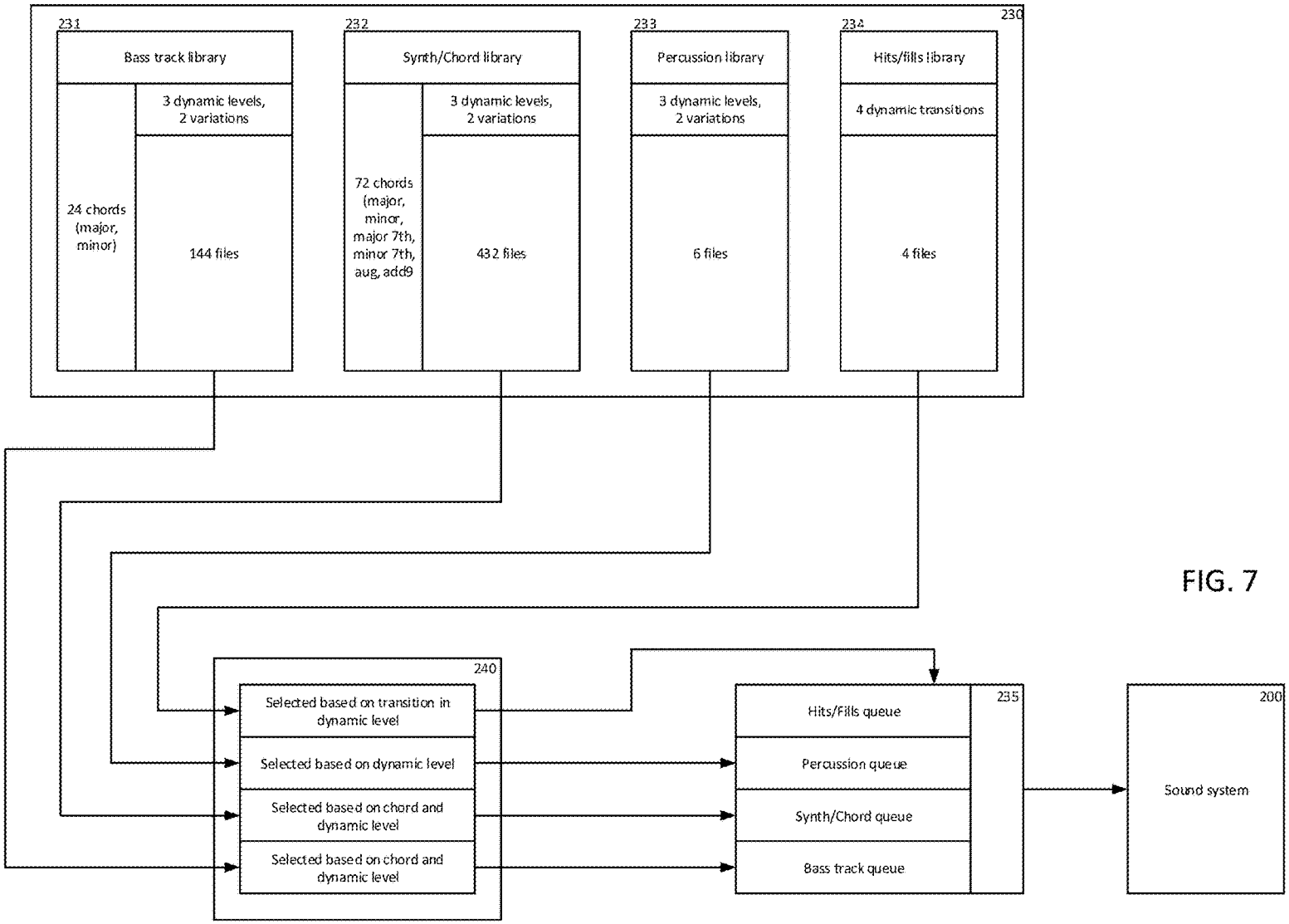
FIG. 7 shows in a block diagram, how sound files can be selected from an audio library, entered in a queue, and played by a sound system.

Reference is now made to FIG. 7, which shows how sound files can be selected from the audio library 230 by the chordlooper 240 and entered in the queue 235 to be played by the sound system 200.

According to this example, the queue 235 includes four tracks, but other alternatives are possible within the scope of the invention. In principle, any number of tracks can be used.

A first track is the bass track. The audio library 230 includes a number of files that can be played in this track. According to the embodiment illustrated in this drawing, the bass track is selected from a selection of 144 files in a bass track library 231. The number of files reflects the possibility of choosing between 24 chords (12 root notes in major and minor), 3 dynamic levels, and 2 variations. Different presets may include a different number of files, representing additional (or fewer) alternatives. For example, it would be possible to add additional variations, representing different bassline patterns (or riffs or grooves), or a preset could include fewer keys than all 24. Also, while this example with 144 files only takes into consideration the root of the currently playing chord and whether it is a minor or a major chord, some presets could include different bassline patterns for additional chords (e.g. seventh chords or sixth chords). It would also be possible within the scope of the invention to add bassline patterns with leading notes that would be used only immediately before a change to a different chord. The chordlooper 240 would then have to include rules for selecting bass track files based on an upcoming chord change.

A similar selection is available for the synth/chord track. However, while it would be possible to limit the number of chords to the same as for the bass track, it may be desirable to include additional chords in the Chord/Synth library. How many, and which chords to include may depend on the preset—the available chords may, for example, differ if the preset is a jazz preset, a blues preset, a folk preset or a pop preset. By way of example a preset could include major and minor chords, major and minor seventh chords, augmented chords and added ninth chords, giving a total of six different chords per root, or a total of 72 different chords. With three dynamic levels and two variations this gives a synth/chord library 232 of 432 sound files.

The percussion library 233 according to this example does not include any tonal information, which means that only six files are included, representing 2 variations and 3 dynamic levels. It is, however, consistent with the principles of the invention to include pitched percussion instruments in the percussion library 233, in which case the number of sound files would have to be increased.

Finally, a library of hits/fills includes 4 sound files that for example may include drum fills and cymbal crashes.

Embodiments of the invention may include fewer or more than the four sound libraries and corresponding queues described here.

The chordlooper 240 selects files from the audio library 230 based on rules. Some of the rules, such as key and dynamic level, have been described above—they are selected by the user using the relevant user interface elements. For the selection of bass track files, additional rules may dictate which variation to choose. One possible rule that is consistent with the principles of the invention, is to simply switch between the two variations for each bar (or fixed number of bars) played with the same chord at the same dynamic level.

Other rules may be contemplated without abandoning the principles of the invention. One example is to include bassline patterns including leading notes before a chord change, as mentioned above.

In embodiments where the synth/chord library 232 includes more chords than the bass track library 231, the user's selection determines the chord selected from the synth/chord library 232, while the bass track may be determined only based on the root note of the chord selected by the user. If the bass track library 231 includes a larger subset of the chords in the synth/chord library 232, the bass track may default to the appropriate standard major or minor chord only if the user selected chord is not available in the bass track library 231.

The chordlooper 240 selects files from the synth/chord library 232. The rules for selecting these files may be different from that which is the case for the bass track library 231, and may also depend on preset. In one embodiment, one variation is selected immediately after a chord change, i.e. during the first bar after a chord change, while the second variation is played for the following bars until the next chord change. Again, alternative or additional rules may be contemplated. For example, variations with leading notes or specific chord variations could be used immediately prior to a chord change and determined based on the following chord.

It should be noted that selecting a sound file from the bass track library 231 or from the synth chord library based on the following chord imposes certain requirements. In order to be able to insert a file into the queue based on a following chord, the user's selection of the following chord must happen before the sound system has started playing the last audio file of the current chord, which means that the key change cannot happen at the end of the current bar unless each bar consists of more than one sound file. Alternatively, the chordlooper must be able to interrupt the playback of the current file and seamlessly start playing a different file in order to achieve the desired end of the last bar before a chord change.

A percussion library includes only 6 files, 2 variations for each dynamic level. In some embodiments the two variations are continuously switched between as long as there are no changes in dynamic level, independent of chord changes. Also here, additional or alternative rules are possible.

Finally, a hits and fills library 234 includes sound files that will be played in association with, but prior to changes in dynamic level. With three dynamic levels, there are four possible changes, two up and two down, for a maximum of four different changes. This gives four different files, unless variations are introduced, which is possible within the scope of the invention, but will not be described in detail.

An alternative way of populating the hits and fills library 234 is to create three files each with a drum fill, and on file with a cymbal crash. The drum fills may be one per dynamic level, to be played just before changing away from that dynamic level, and the cymbal crash may be played each time the dynamic level changes to a higher level.

The sound files from the audio library 230 are entered in the queue 235 to be played sequentially, and they each represent one bar. In some embodiments they may represent several bars, but a bar may also be made up of several sound files (and changes may be implemented at fractions of a bar, for example after two beats of a 4/4 bar). As long as the user does not change chord or dynamic level, the files are chosen only based on chord, dynamic level, and any rules for changing between variations. When the user changes chord and/or dynamic level, the corresponding changes in how the chordlooper selects files are effected and the sound files entered into the queue 235 are selected accordingly, and they will be played at the beginning of the next bar. However, as indicated by the arrow connecting the chordlooper 249 with the hits/fills queue, these files are not queued in the normal manner Instead they are entered in the queue to be played during the current bar. For example, if the user changes to a higher dynamic level, the chordlooper 240 may select a drum fill and then a cymbal crash to be played such that the cymbal crash is played at the very end of the current bar.

In embodiments that implement the ability to select sound files from the synth/chord library 232 or the bass library 231 based on an upcoming chord change, as described above, a similar ability to enter sound files at the head of the queue might be necessary for those tracks.

Generally speaking, chord changes and changes in dynamic level are controlled delayed response to a user interaction, meaning that a change cannot happen before a user interaction, only after, and then only at a well-defined point in time dependent on the beat. This means that if the user input arrives too close to the defined point in time (e.g. the bar change) to be implemented, it will be delayed until the following well-defined point in time (e.g. the next bar change). Changes that take effect prior to the point in time where a chord change may be effected (typically a bar change) represent a special case. For example, if a user input represents a command to change dynamic level at the next bar change, and this change normally includes a transition including a drum fill or a cymbal crash that should be played prior to the change in dynamic level (i.e. prior to the end of the current bar), there will be a limited time window within which the user input must arrive in order for the system to have time to play the transition. If the user input arrives after this activation window, dynamic level will change at the next bar change, but the transition (the drum fill or cymbal crash) will not be played. In other embodiments, the entire change in dynamic will be delayed for another bar and the transition will be played.

The same situation with an activation time window will apply if other sound files (e.g. parts of the bass track) should be selected and played based on chord changes that have not yet taken effect. Those with skill in the art will realize that embodiments where chord changes can take place at bar changes, while a bar includes one sound file per beat, more sophisticated possibilities for transitions are possible, whether the transition is based on a change in dynamic level or a chord change. Generally speaking, receiving the user input ordering the change while there are still one or several complete sound files that will be played before the ordered change takes effect, the possibilities for transitions increase.

The sound files of the four tracks are played simultaneously by the sound system 200. The invention is not limited to four tracks, however, and embodiments may include fewer or additional tracks. While limiting the number of tracks may give a better overall sound quality and be easier for a casual user to configure and operate (play), adding additional tracks with additional sound libraries (for example for additional instruments) may allow more sophisticated users to experiment with different arrangements, orchestrations and compositions.

In the exemplary embodiments described above, it is explained how a chord selection received by the chord selector input module 250 is delivered to the chordlooper 240 and influences how the chordlooper 240 selects new sound files for playback. However, it should be noted that it is in accordance with the principles of the invention to allow the user to select several chord changes ahead of time and store them in a queue of consecutive chords, a chord sequence, for example in a memory area of an electronic device implementing the invention. Such a chord sequence may be created before play commences, or it may be created and/or modified during play. In embodiments implementing this form of chord sequencing, chord changes are delivered from the queue of chords, which may be part of the chord selector input module 250 to the chordlooper 240 as if they were received interactively from the user as already described, i.e. they are each associated with their respective well-defined points in time at which they will take effect.

The invention claimed is:

1. A method in an electronic device for providing a user with accompaniment and improvisation guidance, the electronic device having a memory area, the method comprising:

providing a user interface with a first user interface element allowing a user to select among a plurality of chords, and a second user interface element representing a keyboard from which a user can play a selection of notes;

playing on a sound system at least one sound file from an audio data library, the selection of which being based on a current selection of one of the plurality of chords, and adapting the second user interface element to emphasize at least a triad of notes belonging to the currently selected chord;

upon receipt of a user input representing selection of a next chord, wait until a well-defined point in time to:

terminate playback of the at least one sound file selected based on the currently selected chord;

commence playback of at least one sound file from the audio data library, the selection of which being based on the selection of a next chord; and update the second user interface element to emphasize at least a triad of notes belonging to the next chord;

the method further comprising temporarily storing sound files from the audio data library in the memory area, the sound files being stored in a queue to be played on the sound system.

2. The method according to claim 1, wherein the well-defined point in time is defined by the beat of the music of the sound file being played.

3. The method according to claim 2, wherein the well-defined point in time is at the completion of a currently playing bar.

4. The method according to claim 2, wherein the well-defined point in time is at the completion of a predetermined number of bars.

5. The method according to claim 2, wherein the well-defined point in time is at the completion of a predefined number of beats into the currently playing bar.

6. The method according to claim 1, wherein the first user interface element or an additional user interface element is configured to always identify a currently selected chord.

7. The method according to claim 1, wherein the at least a triad of notes is emphasized by being represented by larger keys than the notes that are not emphasized.

8. The method according to claim 1, wherein the at least a triad of notes is emphasized by being represented by keys with a symbol superimposed on them.

9. The method according to claim 1, wherein the at least a triad of notes is emphasized by their color.

10. The method according to claim 1, wherein the user interface is a graphical user interface provided on the display of the electronic device.

11. The method according to claim 10, wherein the second user interface element is a representation only of the keys associated with the scale of a currently selected musical key.

12. The method according to claim 10, wherein the second user interface element is a representation of a piano type keyboard.

13. The method according to claim 1, wherein the second user interface element is a physical keyboard and wherein the at least a triad of notes is emphasized by a light emitted adjacent to or embedded in the keys of the keyboard.

14. The method according to claim 1, wherein received user input representing selection of a next chord is stored in a sequence of selected chords and associated with respective well-defined points in time to be consecutively treated as a next chord.

15. A computer program product stored on a computer readable medium and including instructions which will allow an electronic device to perform a method according to claim 1 when executed.

16. An electronic device for providing a user with accompaniment and improvisation guidance, comprising a sound system module;

a synthesizer module;

an audio data library;

a chordlooper;

a user interface module; wherein:

the user interface module is configured to provide a user interface with a first user interface element allowing a user to select among a plurality of chords, and a second user interface element representing a keyboard from which a user can control the synthesizer module to play a selection of notes through the sound system module;

the chordlooper is configured to receive user input from the first user interface element identifying a selected next chord, and upon receipt of such user input, wait until a well-defined point in time to:

terminate playback through the sound system of any sound file selected from the audio data library based on a currently selected chord;

commence playback through the sound system of at least one sound file selected from the audio data library, the selection of which being based on the received user input identifying a selected next chord; and instruct the user interface module to update the second user interface element to emphasize at least a triad of notes belonging to the selected next chord; and a memory area configured to temporarily store sound files in a queue to be played by the sound system; and into which the chordlooper is configured to enter sound files from the audio data library.

17. The electronic device according to claim 16, wherein the well-defined point in time is defined as the point in time at which a selected sound file entered in the queue has finished playing.

18. The electronic device according to claim 17, wherein the point in time at which the selected sound file entered in the queue has finished playing corresponds to one of the completion of a currently playing bar;

the completion of a predetermined number of bars; and the completion of a predefined number of beats into the currently playing bar.

19. An electronic device for providing a user with accompaniment and improvisation guidance, comprising a sound system module;

a synthesizer module;

an audio data library;

a chordlooper;

a user interface module; wherein:

the user interface module is configured to provide a user interface with a first user interface element allowing a user to select among a plurality of chords, and a second user interface element representing a keyboard from which a user can control the synthesizer module to play a selection of notes through the sound system module;

the chordlooper is configured to receive user input from the first user interface element identifying a selected next chord, and upon receipt of such user input, wait until a well-defined point in time to:

terminate playback through the sound system of any sound file selected from the audio data library based on a currently selected chord;

commence playback through the sound system of at least one sound file selected from the audio data library, the selection of which being based on the received user input identifying a selected next chord; and instruct the user interface module to update the second user interface element to emphasize at least a triad of notes belonging to the selected next chord; and a memory area for storing received user input from the first user interface element identifying a selected next chord in a queue of selected chords and associating each selected chord with a well-defined point in time, and for consecutively delivering selected chords from the queue to the chordlooper.

20. A method in an electronic device for providing a user with accompaniment and improvisation guidance, the electronic device having a memory area, the method comprising:

providing a user interface with a first user interface element allowing a user to select among a plurality of chords, and a second user interface element representing a keyboard from which a user can play a selection of notes;

playing at least one sound file from an audio data library, the selection of which being based on a current selection of one of the plurality of chords, and adapting the second user interface element to emphasize at least a triad of notes belonging to the currently selected chord; and upon receipt of a user input representing selection of a next chord, wait until a well-defined point in time to:

terminate playback of the at least one sound file selected based on the currently selected chord;

commence playback of at least one sound file from the audio data library, the selection of which being based on the selection of a next chord; and update the second user interface element to emphasize at least a triad of notes belonging to the next chord;

the method further comprising storing in the memory area a received user input from the first user interface element identifying a selected next chord in a queue of selected chords and associating in the memory area each selected chord with a well-defined point in time, and for consecutively delivering selected chords from the queue to a chordlooper.

21. A computer program product stored on a computer readable medium and including instructions which will allow an electronic device to perform a method according to claim 20 when executed.

* * * * *